US009004150B2

(12) United States Patent
Naveau et al.

(10) Patent No.: US 9,004,150 B2
(45) Date of Patent: Apr. 14, 2015

(54) METHOD FOR CONTINUOUS CASTING OF A METAL WITH IMPROVED MECHANICAL STRENGTH AND PRODUCT OBTAINED BY SAID METHOD

(75) Inventors: Paul Naveau, Alleur (BE); Astrid De Ro, Moha (BE)

(73) Assignee: Centre de Recherches Metallurgiques ASBL—Centrum Voor Research in de Metallurgie VZW, Brussels (BE)

( * ) Notice: Subject to any disclaimer, the term of this patent is extended or adjusted under 35 U.S.C. 154(b) by 0 days.

(21) Appl. No.: 13/151,479

(22) Filed: Jun. 2, 2011

(65) Prior Publication Data

US 2011/0250090 A1 Oct. 13, 2011

Related U.S. Application Data

(63) Continuation-in-part of application No. 11/883,979, filed as application No. PCT/BE2006/000003 on Jan. 19, 2006, now abandoned.

(30) Foreign Application Priority Data

Mar. 16, 2005 (BE) ..... 2005/0139

(51) Int. Cl.
*B22D 11/108* (2006.01)

(52) U.S. Cl.
CPC ..... *B22D 11/108* (2013.01)

(58) Field of Classification Search
USPC ..... 164/97, 98, 461, 473
See application file for complete search history.

(56) References Cited

U.S. PATENT DOCUMENTS

| | | | | |
|---|---|---|---|---|
| 4,874,471 | A | 10/1989 | Wilmotte | |
| 5,305,817 | A * | 4/1994 | Borisov et al. | 164/97 |
| 6,251,159 | B1 | 6/2001 | Angeliu et al. | |
| 2003/0173721 | A1 | 9/2003 | Naveau | |
| 2003/0205350 | A1 * | 11/2003 | Kono | 164/113 |
| 2004/0016318 | A1 * | 1/2004 | Angeliu | 75/332 |
| 2004/0208774 | A1 * | 10/2004 | Zhang | 419/48 |
| 2009/0266506 | A1 | 10/2009 | Naveau et al. | |

FOREIGN PATENT DOCUMENTS

| | | | |
|---|---|---|---|
| BE | 1012037 | A3 | 4/2000 |
| DE | 10253577 | A1 | 5/2004 |
| EP | 0269180 | A2 | 6/1988 |
| EP | 0605379 | A1 | 7/1994 |
| WO | WO 0230598 | A1 | 4/2002 |

OTHER PUBLICATIONS http://www.themetalcasting.com/powder-metallurgy.html, Mar. 17, 2010.*

* cited by examiner

*Primary Examiner* — Kevin E Yoon
(74) *Attorney, Agent, or Firm* — Reinhart Boerner Van Deuren P.C.

(57) ABSTRACT

A new method for continuous casting of molten metal is provided that allows one to obtain an intermediate product such as slab, billet wire, etc. before subsequent thermomechanical treatment (e.g. lamination or annealing), such that its chemical composition is modified by the addition of elements in order to give it greater mechanical strength.

17 Claims, 1 Drawing Sheet

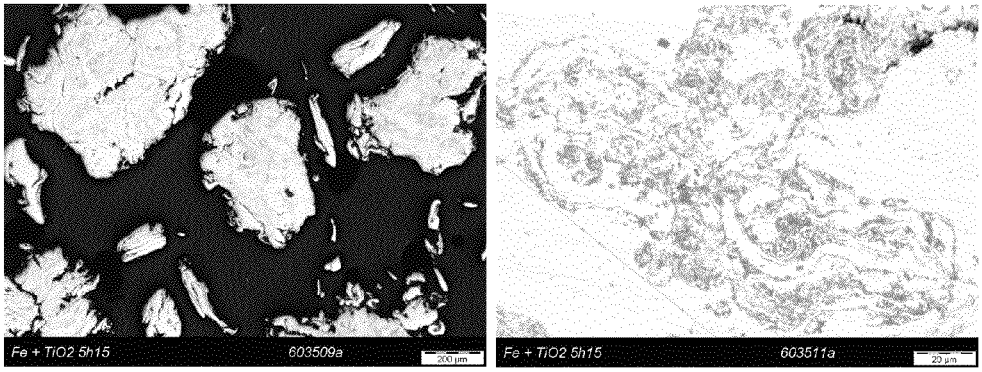
Fe + TiO2 5h15
603509a
200 µm
Fe + TiO2 5h15
603511a
20 µm

METHOD FOR CONTINUOUS CASTING OF A METAL WITH IMPROVED MECHANICAL STRENGTH AND PRODUCT OBTAINED BY SAID METHOD

CROSS-REFERENCE TO RELATED PATENT APPLICATIONS

This patent application is a continuation-in-part of co-pending U.S. patent application Ser. No. 11/883,979, filed Mar. 7, 2008, which is a nationalization of PCT Application No. PCT/BE2006/000003, filed Jan. 19, 2006, which claims the benefit of Belgium Patent Application No. 2005/0139, filed Mar. 16, 2005, the entire teachings and disclosure of which are incorporated herein by reference thereto.

FIELD OF THE INVENTION

The present invention relates to a new method for the continuous casting of a molten metal, in particular steel, that allows to obtain an intermediate product such as a slab, billet, wire, etc. before subsequent thermomechanical treatment such as lamination, continuous annealing, etc., such that its chemical composition is modified by the addition of elements in order to give it greater mechanical strength.

The following description makes more specific reference to the continuous casting of steel. However, this choice is only an example and does not entail any limitation of the invention.

The invention also relates to the product with improved mechanical features obtained by the method.

STATE OF THE ART

The technique of the continuous casting of steel is well known. It essentially consists in feeding molten steel from a ladle or from a tundish into a cooled copper or copper-alloy mould called "continuous casting ingot mould", the latter being open at its bottom end, and in extracting from this opening an ingot in the form of a partly solidified continuous sheet.

In general, the molten steel is fed into the ingot mould by means of at least one nozzle, i.e. a generally tubular element positioned between the tundish and the ingot mould. The bottom end of the nozzle is usually provided with one or two outlet apertures located on the axis of the nozzle or on the sides, and comes out below the level that is free of molten steel present in the ingot mould.

Developments of the nozzles are also known that are intended to achieve improved cooling of the too hot molten steel coming from the tundish. The aim is to obtain steel in the form of a paste upon its entry into the ingot mould. These nozzles may in particular comprise a heat exchanger with a water-cooled copper tube or even a deflector or a dome. The latter has the purpose of forcing the overheated steel to trickle down in a thin layer along the walls of the nozzle, which allows to significantly increase the area of thermal exchange. The cooling of the conduit ensures the removal of the excess heat from the steel and causes the appearance of a solid fraction which turns the steel into a paste upon its entry into the ingot mould. The introduction of a protective gas under pressure, for example argon, in the conduit causes an overload that prevents any air flow by the molten steel, which would lead to its oxidisation or to the formation of alumina and the clogging of the nozzle. This technique described in patent EP-B-269-180 is called casting with a hollow jet or by means of a HJN or hollow jet nozzle.

Another development, described in patent EP-B-605 379, relates to the injection into the hollow jet of some quantity of finely divided metal material by using a non-oxidising gas as a vector at a slightly higher pressure relative to atmospheric pressure in order to prevent any entry of air. Depending on the case, the aim is to obtain refinement of the solidification structure by creating new solidification seeds or a modification of the basic chemical composition of the steel.

A continuous casting nozzle with a rotating jet is also known, as described in patent BE-A-101 20 37, and composed of a vertical conduit with a distribution device or dome in its upper part, whose function is also to divert the metal entering the nozzle towards the internal surface of said conduit and which comprises three arms arranged in a star pattern relative to the nozzle axis and canted relative to the horizontal. These arms are configured so as to impart a helicoidal rotary motion along the inner wall to the molten steel. The molten steel then comes out through two side outlets in the nozzle at a speed that is significantly lower than that obtained with a conventional nozzle with the same flow, which improves the quality of the ingots extracted (less inclusions and less gas bubbles).

The continuous casting of steel-based products with a mixed chemical or bi-component composition has also aroused great interest in a large number of specific applications, both for long and flat products (for example reduction of the silicon level at the surface of the slabs, in order to improve the suitability of laminated products to galvanisation; modification of the carbon content at the surface of peritectic steels to improve their casting flow; casting of products whose mechanical properties vary along their thicknesses, such as for instance great strength at the surfaces and high ductility in the cores, etc.). The term bi-component refers to products with a chemical composition of steel that varies depending on its position in the product studied, for example varying in the skin compared with the core. To meet this requirement, the Applicant proposed in international patent application WO-A-02/30598 a continuous casting nozzle comprising a distribution device with a dome in its top part, designed to separate the molten steel into two streams, an inner stream and an outer stream, in two physically well-separated zones. A means for injecting a gas, liquid or finely divided solid material (a powder with a particle size typically greater than 100 microns) under the dome into the inner zone allows the formation of a steel with a chemical composition that is different to that of the basic steel, cast in the outer zone.

In addition, it is known that traditional thermomechanical treatments aimed at improving the mechanical features of a steel, for example by its microstructure (martensite, bainite, etc.) or by endogenous precipitation, have the drawback that the structure of the steel finally obtained may be adversely affected by thermal post-treatment of the product (for example welding, galvanisation, etc.). It would therefore be desirable, at least in some cases, to be able to cast directly a product with a structure, and hence mechanical properties, that are stable throughout any subsequent treatment that the product might undergo.

AIMS OF THE INVENTION

The present invention aims to provide a solution that allows to overcome the drawbacks of the state of the art.

The present invention aims in particular to provide a method of continuous casting that allows to produce slabs or billets of a modified chemical composition adapted to give the steel greater mechanical strength before lamination.

The invention notably aims to obtain a steel of homogeneous chemical composition and/or stabilised structure relative to a lamination process and/or thermomechanical treatment subsequent to casting.

One particular aim of the present invention is to exploit the hollow-jet technique in order to inject finely divided ceramic particles through the continuous casting nozzle.

MAIN CHARACTERISTIC ELEMENTS OF THE INVENTION

A first aim of the present invention relates to a method for the continuous casting of a metal, in the form of a hollow jet in a nozzle positioned between a ladle or a tundish and a continuous casting ingot mould, said nozzle comprising in its upper part a distribution device capable of diverting at least part of the molten metal arriving at the inlet of the nozzle towards an inner wall in the nozzle before it enters the ingot mould, said method comprising the injection in an internal volume of the hollow jet of finely divided solid material comprising nanoparticles of technical ceramic with a characteristic size of less than 200 nm, and preferably of less than 100 nm, said nanoparticles being conglomerated, prior to their injection into the nozzle, into pellets of a size between 10 and 1,000 microns, and preferably between 100 and 200 microns, characterised in that said pellets comprise the nanoparticles and a metal matrix.

Advantageously, the nanoparticles of technical ceramic comprise nanoparticles of oxides, nitrides, carbides, borides, silicides and/or compounds thereof.

The oxides are preferably $Al_2O_3$, $TiO_2$, $SiO_2$, MgO, $ZrO_2$ or $Y_2O_3$.

As a further advantage, the size of the nanoparticles is between 10 and 100 nm.

Still according to the invention, the quantity of nanoparticles incorporated into the molten metal is lower than or equal to 5%, and preferably between 0.1 and 1% by weight of cast metal.

According to a preferred embodiment of the invention, the pellets injected into the internal volume of the hollow jet of the nozzle are in suspension in a non-oxidising gas, preferably argon, said gas being at slightly higher pressure relative to atmospheric pressure and at most equal to the static pressure of the cast metal upon its entry into the ingot mould.

According to another preferred embodiment of the invention, the pellets are injected into the internal volume of the hollow jet of the nozzle by means of a mechanical conveyance device such as a worm screw.

As a particular advantage, the nanoparticles are conglomerated prior to their injection into the nozzle into pellets of a size essentially between 10 and 1,000 microns, and preferably between 100 and 200 microns.

Still advantageously, prior to their injection into the nozzle, the nanoparticles are conglomerated into a metal matrix made of the same metal or of a different metal to the cast metal.

The cast metal is preferably molten steel and the metal matrix is an iron matrix or the metal matrix comprises a alloy metal other than iron.

As a further advantage, the conglomeration of the nanoparticles is obtained by mixing ceramic nanoparticles with micrometric particles, i.e. particles of a size greater than 10 microns, and preferably less than 200 microns.

According to a first preferred method, said mixture is produced by a pre-mix in a slurry, followed by drying, crushing, isostatic pressing and further crushing.

According to a second preferred method, said mixture is produced by high-energy tapping of the type "mechanical alloying" so as to incorporate the ceramics into the metal matrix.

According to a first advantageous embodiment, the hollow-jet nozzle used is of the type rotating jet, i.e. it comprises a vertical conduit having a distribution device with a dome in its upper part, whose function is to divert the molten metal entering the nozzle towards the internal surface of said conduit and which comprises a series of arms arranged symmetrically in a star pattern relative to the axis of the nozzle and canted relative to the horizontal, said arms being arranged to impart a helicoidal rotary motion to the molten metal along the inner wall of the nozzle.

According to another advantageous embodiment, the hollow-jet nozzle used comprises a distribution device with a dome in its upper part designed to separate the molten metal into two streams, an inner stream and an outer stream, in two physically well-separated zones, the injection of pellets under the dome in the inner zone allowing the formation of a metal with a different chemical composition to that of the basic metal, cast in the outer zone.

Alternatively, the injection of pellets may be carried out in the outer zone of the nozzle.

A second aim of the present invention relates to a metal, preferably steel, with high mechanical strength and taking the form after casting of an ingot in a continuous sheet upon its exit from a continuous casting ingot mould, specifically obtained by means of the above-described method and comprising less than one percent by weight of technical ceramic homogeneously distributed in at least one part of the ingot.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIG. 1 shows optical microscopy images of the powder made up of Fe and $TiO_2$ and obtained by mechanical alloying.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The idea on which the invention is based is to develop a metal or metal alloy hardened by a fine dispersion of ceramic particles that give the metal or metal alloy stable properties that do not deteriorate because of subsequent thermal treatment(s).

By way of an example, the case of the continuous casting of steel will be considered.

It is therefore proposed to cast a standard basic steel to which is added, as required, a quantity of particles needed to obtain the strength properties desired. As an advantage, the addition of particles to the molten metal is carried out directly at the level of the continuous casting nozzle since the latter, in the embodiments generally used and described above, generally comprises a means for inserting alloy elements or oxides in at least one fraction of the molten metal passing through the nozzle.

According to the invention, the particles added are ceramic particles. The man skilled in the art knows that technical or industrial ceramics refer to a class of manufactured materials that are non-metallic and inorganic. They are divided into two main groups: the oxides (for example $Al_2O_3$, $TiO_2$, $SiO_2$, MgO, $ZrO_2$, $Y_2O_3$, etc.) and the non-oxides (nitrides, carbides, borides, silicides, etc.). Moreover, for the requirements of the invention, the ceramic particles must comply with the following operational definition: they are of a nanometric size, typically 10-100 nanometers (1 nm=$10^{-9}$ m), and after incorporation into the molten steel, they are essentially homogeneously distributed throughout the entire section of the cast product. The "size" of the particles is meant here as the largest dimension of the particle. The nanometric nature of the particles for inclusion is in fact indispensable to the reinforcement of the product. By contrast, micrometric inclusions constitute defects, heterogeneous areas that make the product weaker.

The quantities of nanoparticles added to the molten steel are maximum 1% by weight.

The wettability of the particles in the molten steel is the most important criterion for the choice of particles and the resolution of this technical problem is at the heart of the present invention. Homogeneous distribution of the nanoparticles in the molten steel is indispensable, which excludes confinement of the powders injected to the surface of the molten steel.

According to the invention, the particles may advantageously be conglomerated up to a size of 100-200 μm so as to be able to be injected through the HJN nozzle.

To improve the wettability of the particles in the molten steel, the nanometric ceramic particles may be conglomerated in an iron or metal matrix to obtain a compound, also called pellet, whose characteristic final size is 100-200 μm. The iron or metal matrix favours the dispersion of the particles in the molten steel. In order to obtain this compound, nanometric ceramic particles are used mixed with micrometric metal particles (whose size is for example 10 to 200 microns). The composition of the metal particles can be adjusted depending on the composition of the cast metal and on wettability requirements. It can be pure metal (Fe, Ni, . . . ) or metal alloy such as carbon steel or stainless steel.

The pellets must have a sufficient cohesion to avoid their dissociation during the injection. Also to guarantee a percentage of nanoparticles in the final product between 0.1 and 1% by weight of cast metal, the percentage of nanoparticles in the pellets must be at least of 5 wt % and preferably between 10 and 30 wt %.

The pellets are preferably produced either by:

- mixing into a slurry and then drying, crushing, isostatic pressing and then re-crushing;
- high-energy tapping (mechanical alloying) to ensure that the ceramics are incorporated into the metal matrix.

In the first method, the nanoparticles are dispersed in a solvent, for example, ethanol, to make the slurry. The mix is then milled to break the nanoparticle clusters and the micrometric particles are then added. For example, the micrometric particles have a size ranging from 10 to 20 μm. Afterwards, the slurry is dried in a rotary evaporator and crushed. To improve the cohesion of the pellets, the crushed product is cold pressed by isostatic pressing with a pressure ranging from 1000 to 2000 bars. The resulting cake is then crushed and sieved in pellets with the aimed size.

In the second method, the pellets are prepared in a high-energy ball mill comprising a mix of nanoparticles and micrometric particles. The milling time is carefully chosen to get pellets with the appropriate size. The optimum milling time depends on the experimental conditions. For example, the tests carried out with 95 wt % Fe powder (150 μm) and 5 wt % $TiO_2$ nanoparticles in a planetary ball mill comprising 275 stainless balls of 10 mm diameter and operating with a rotating speed of 300 rpm have shown that pellets with an average size close to 150 μm are obtained for a milling time of about 6 hours. The resulting pellets are displayed in FIG. 1. The nanoparticles are well dispersed in the metal matrix.

Advantageously, these pellets are injected under gaseous atmosphere in the HJN nozzle (see patent EP-B605 379). The heavy turbulence occurring in the nozzle thus allows good incorporation of the particles into the molten steel.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. Method for a continuous casting of molten metal in the form of a hollow jet in a nozzle positioned between a ladle or a tundish and a continuous casting ingot mould, said nozzle comprising in its upper part a distribution device capable of diverting at least part of the molten metal arriving at the inlet of the nozzle towards an inner wall of the nozzle before it enters the ingot mould, said method comprises the injection into an internal volume of the hollow jet of finely divided solid material comprising nanoparticles of technical ceramic with a characteristic size lower than 200 nm, said nanoparticles being conglomerated prior to their injection into the nozzle into solid pellets of a size between 10 and 1,000 microns, characterised in that said solid pellets comprise the nanoparticles and a metal matrix, wherein said pellets have a sufficient cohesion to avoid their dissociation during the injection, wherein said nanoparticles are oxide nanoparticles selected from the group consisting of $Al_2O_3$, $TiO_2$, $SiO_2$, MgO, $ZrO_2$ and $Y_2O_3$, and wherein the nanoparticles are incorporated in a quantity between 0.1 and 1% by weight of the casted molten metal.

2. The method according to claim 1, wherein the characteristic size of the nanoparticles is lower than 100 nm.

3. The method according to claim 2, wherein the size of the nanoparticles is between 10 and 100 nm.

4. The method according to claim 1, wherein the size of the solid pellets is between 100 and 200 microns.

5. The method according to claim 1, wherein the molten metal is molten steel.

6. The method according to claim 1, wherein the metal matrix is made of a pure metal or a metal alloy.

7. The method according to claim 6, wherein the metal matrix is made of pure iron or an iron alloy.

8. The method according to claim 1, wherein the solid pellets injected into the inner volume of the hollow jet of the nozzle are in suspension in a non-oxidising gas, said gas being at a slightly higher pressure relative to atmospheric pressure and at most equal to the static pressure of the casted molten metal upon its entry into the ingot mould.

9. The method according to claim 1, wherein the solid pellets are injected into the inner volume of the hollow jet of the nozzle by means of a mechanical conveyance device.

10. The method according to claim 1, wherein the solid pellets are obtained by mixing ceramic nanoparticles with micrometric particles, the micrometric particles having a size greater than 10 microns.

11. The method according to claim 10, wherein said micrometric particles have a size lower than 200 microns.

12. The method according to claim 1, wherein the percentage of nanoparticles in the solid pellets ranges from 5 to 25 wt %.

13. The method according to claim 1, wherein the solid pellets are produced by a premix in a slurry, followed by drying, crushing, isostatic pressing and re-crushing.

14. The method according to claim 1, wherein the solid pellets are produced by high-energy tapping to ensure that the ceramics are incorporated into the metal matrix.

15. The method according to claim 1, wherein the hollow jet nozzle used is of the rotary jet type comprising a vertical conduit having a distribution device with a dome in its upper part, whose function is to divert the molten metal entering the nozzle towards the inner surface of said conduit and which comprises a series of arms symmetrically arranged in a star pattern relative to the axis of the nozzle and canted relative to the horizontal, said arms being arranged to impart a helicoidal rotary motion to the molten metal along the internal wall of the nozzle.

16. The method according to claim 1, wherein the hollow jet nozzle used comprises in its upper part a distribution device with a dome designed to separate the molten metal into two streams, an inner stream and an outer stream, in two physically well-separated zones, the injection of the solid pellets under the dome in the inner zone allowing the formation of a metal with a different chemical composition to that of the basic metal, cast in the outer zone.

17. The method according to claim 16, wherein the injection of the solid pellets is alternatively produced in the outer zone.

* * * * *